US005362272A

United States Patent [19]

Chow et al.

[11] Patent Number: 5,362,272

[45] Date of Patent: Nov. 8, 1994

[54] ACTIVITY TOY AND WALKER DEVICE

[75] Inventors: Chi K. W. Chow, Shatin; Frederick L. T. Tsang, Sai Ying Pun, both of Hong Kong

[73] Assignee: Vtech Industries, Inc., Wheeling, Ill.

[21] Appl. No.: 146,230

[22] Filed: Nov. 1, 1993

[51] Int. Cl.[5] ..... A63H 11/12; A63H 17/00; A63H 5/00; A63H 33/02

[52] U.S. Cl. ..... 446/278; 446/78; 446/409; 446/451; 280/47.38

[58] Field of Search ..... 446/71, 72, 73, 77, 446/78, 80, 81, 275, 278, 269, 268, 287, 409, 411, 412, 413, 440, 450, 451, 487; 280/47.38; 482/77

[56] References Cited

U.S. PATENT DOCUMENTS

| | | | |
|---|---|---|---|
| D. 321,216 | 10/1991 | Pape et al. . | |
| D. 333,060 | 2/1993 | Perego . | |
| 1,617,665 | 2/1927 | Cashoty | 482/77 |
| 2,017,213 | 10/1935 | Laborda | 482/77 X |
| 2,884,046 | 4/1959 | Patrick . | |
| 2,996,303 | 8/1961 | Peltier | 482/77 X |
| 3,181,270 | 5/1965 | Trevena | 446/278 |
| 3,309,101 | 3/1967 | Romay | 280/47.38 |
| 3,334,909 | 8/1967 | Smith et al. | 280/47.38 X |
| 3,371,927 | 3/1968 | Ryan et al. | 482/77 |
| 3,765,693 | 10/1973 | Morrison et al. | 482/77 X |
| 4,476,649 | 10/1984 | Zaruba . | |
| 4,597,744 | 7/1986 | Rehkemper et al. | 446/278 |
| 4,943,256 | 7/1990 | Symons | 446/278 X |
| 5,071,149 | 12/1991 | Perego . | |
| 5,154,658 | 10/1992 | Marcus . | |

FOREIGN PATENT DOCUMENTS

| | | | |
|---|---|---|---|
| 531418 | 1/1922 | France | 446/78 |
| 2151149 | 7/1985 | United Kingdom | 446/487 |

OTHER PUBLICATIONS

Copy of U.S. design patent application Ser. No. 29/010,661, filed on Jul. 14, 1993 for a Walker design, wherein the invention was designed by the same inventors as the present application and assigned to the same corporation.

*Primary Examiner*—Robert A. Hafer
*Assistant Examiner*—D. Neal Muir
*Attorney, Agent, or Firm*—Dick and Harris

[57] ABSTRACT

An activity toy and walker device for prompting and promoting interactive play, motor skill development and intellectual development of a child. A frame having a first portion and a second portion is deployable between a substantially collapsed orientation and a substantially upright orientation. Both of the first and second portions include a top end region and a bottom end region. When the frame is in its substantially collapsed orientation, the top end region of the second portion will be positioned proximate to the bottom end region of the first portion. When the frame is in its substantially upright orientation, the top end region of both of the first and second portions will be positioned proximate to each other. The device further includes an activity toy releasably attached to either the first or second portion of the frame for enabling use of same with the walker, or, alternatively separate and apart from the walker.

12 Claims, 2 Drawing Sheets

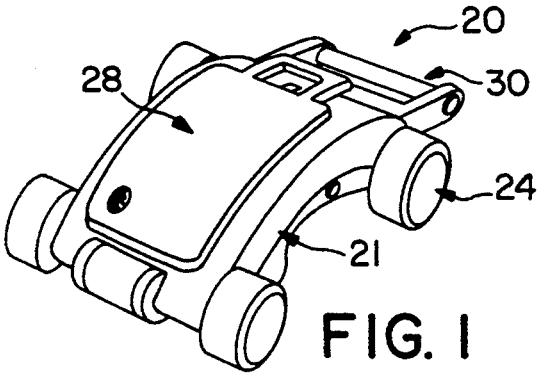
FIG. 1
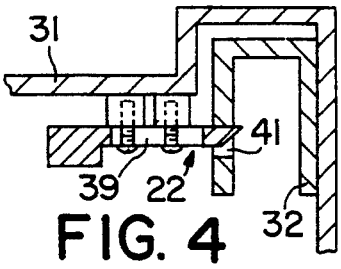
FIG. 4
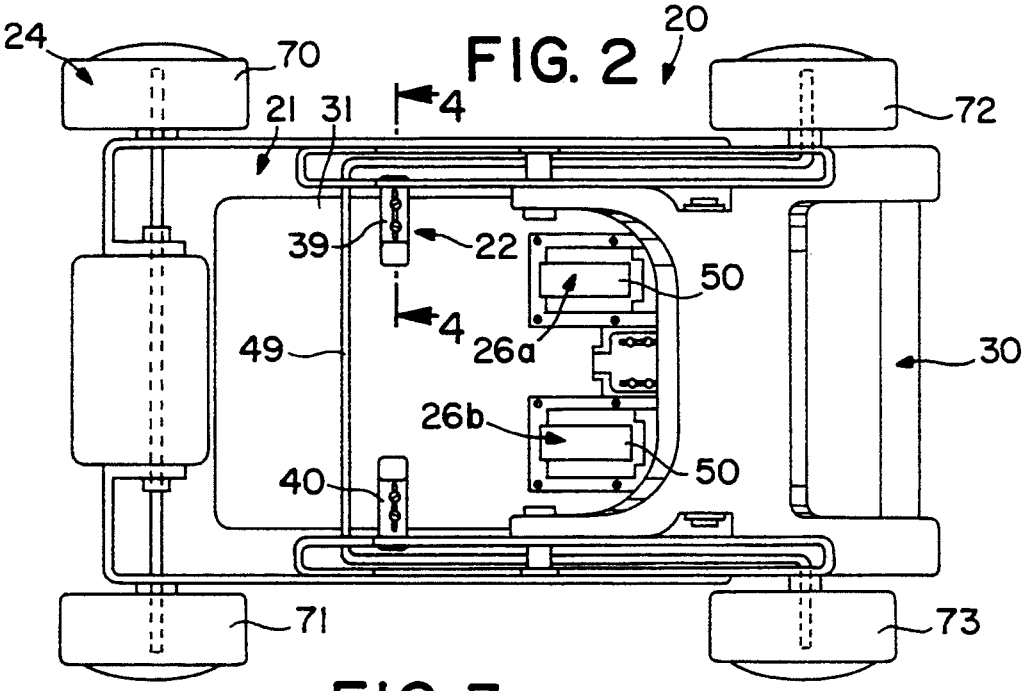
FIG. 2
FIG. 3
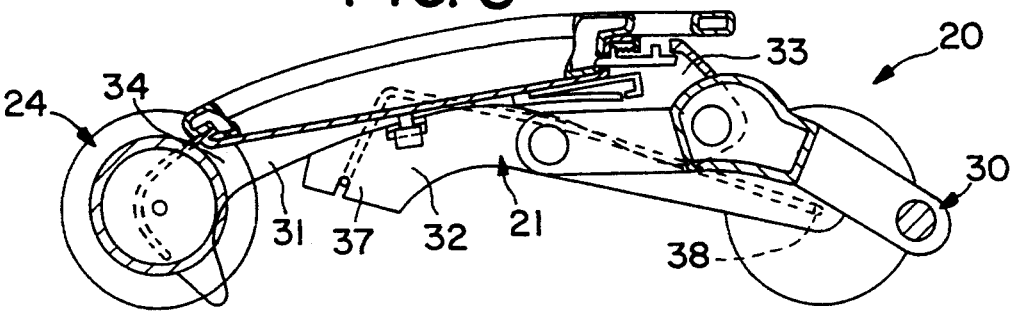
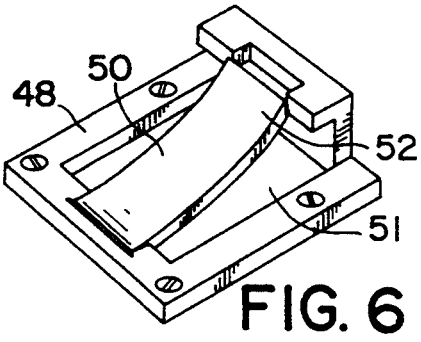
FIG. 6
FIG. 5
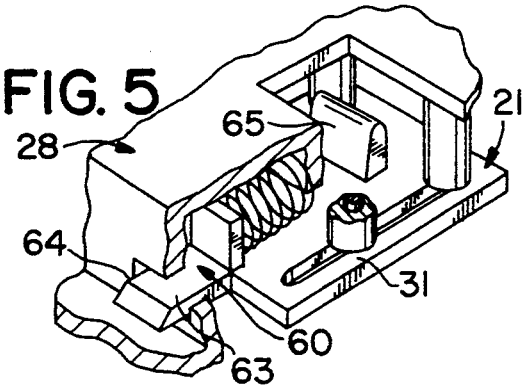

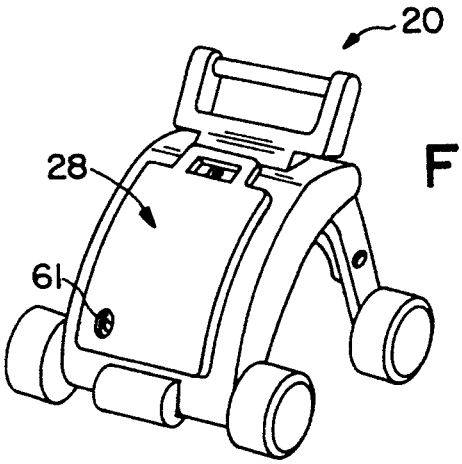
FIG. 7
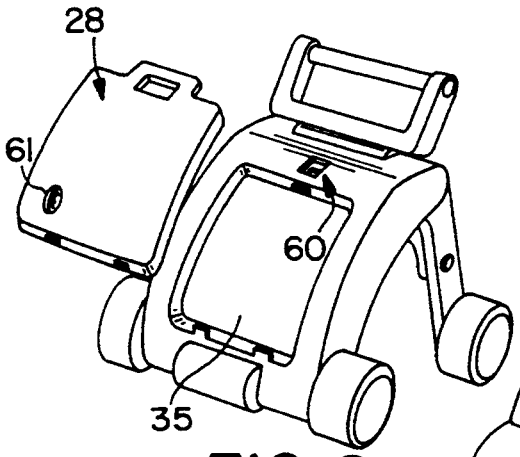
FIG. 8
FIG. 9
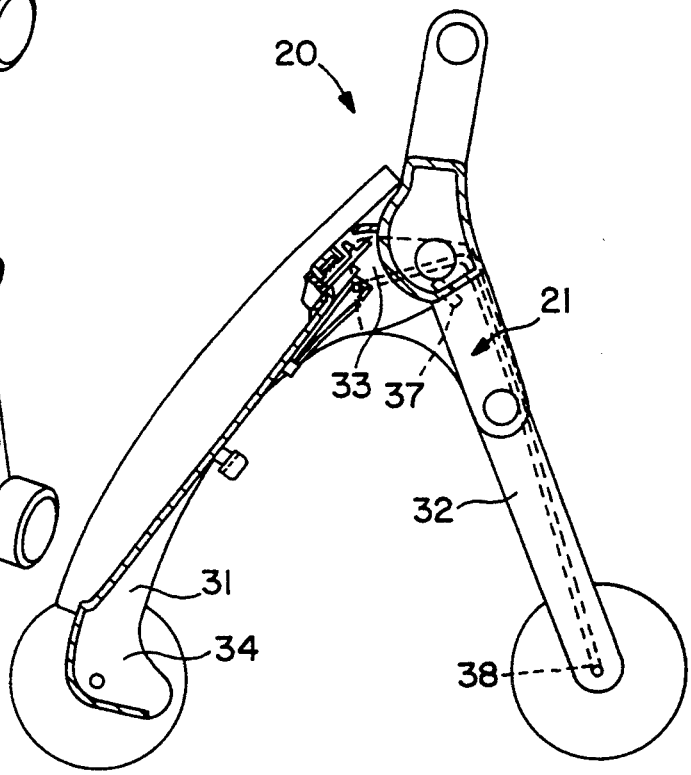
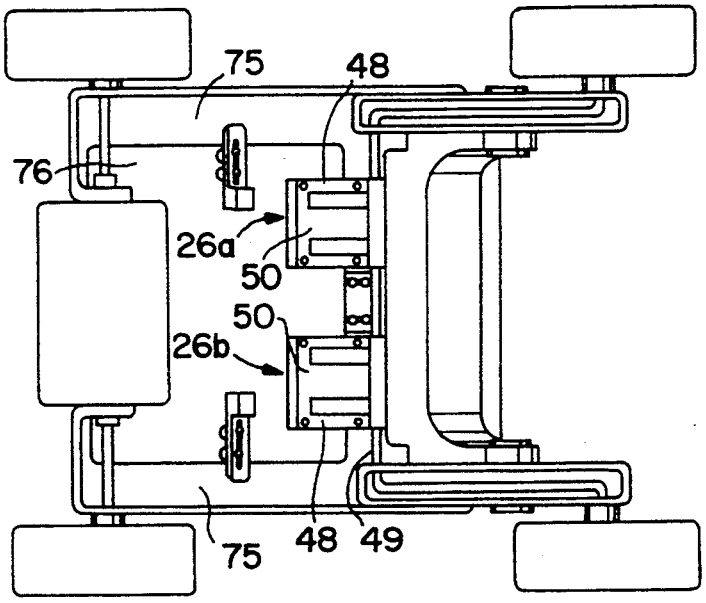
FIG. 10

ACTIVITY TOY AND WALKER DEVICE

BACKGROUND OF THE INVENTION

1. Field of the Invention

This invention relates generally to activity toys and infant walkers, and more particularly to an activity toy and walker device for prompting and promoting interactive play, motor skill development and educational development of a child.

2. Background Art

Walkers of the type primarily intended to aide infants in their walking development, have been around for many years. Furthermore, several of such prior art devices have been constructed so as to enable positioning of the walker between a substantially collapsed orientation and a substantially upright orientation, two examples of which are: Patrick, U.S. Pat. No. 2,884,046; and Pape et al., U.S. Pat. No. Des. 321,216. Patrick, '046, discloses a walker comprising a substantially rectangular truncated pyramide shaped frame and a handle member. The handle member is retractable and the frame can be telescopically compressed upon positioning of the walker into its collapsed orientation. Pape et al. '216, although shown in a substantially upright orientation, is indeed collapsible. Pape et al., '216 includes a frame comprised of a top portion, a bottom portion and two support bars. Collapsing of the frame is accomplished by releasing both of the two support bars from their lockable engagement with the bottom portion, and then folding each of the support bars toward the top portion. Either after the folding of the support bars, or simultaneously therewith, both the top portion and the support bars are pivoted adjacent the bottom portion of the frame. Although such prior art walkers have been suitable for use by a child, they have required excessive material and/or elements in their construction, and are rather burdensome and time consuming relative to their deployability between the collapsed and erected orientations.

Activity sets used in association with walkers have also been known in the art for several years—such as shown in Pape et al. '216. Although such activity toy/-walker combinations have been functionally acceptable as a unitary device, none of such prior art appears to disclose activity devices which are releasably attached to the frame of the walker itself for enabling independent use of the activity set separate and apart from the walker to which it is releasably attached.

SUMMARY OF THE INVENTION

The present invention comprises an activity toy and walker device for prompting and promoting interactive play, motor skill development and intellectual development of a child. The activity toy and walker device comprises a frame having a first portion and a second portion operatively attached to each other. Both of the first and second portions include a top end region and a bottom end region.

Deployment means are operatively associated with the first and second portions of the frame for enabling deployable positioning of the frame from a substantially collapsed orientation toward and into a substantially upright orientation. Each of the top end regions of the first and second portions of the frame are positioned proximate to each other when the frame is in a substantially upright orientation, and, the top end region of one of the first and second portions of the frame is positioned proximate the bottom end region of the other one of the first and second portions when the frame is in a substantially collapsed orientation. Wheel means are operatively attached to the bottom end regions of the first and second portions of the frame means for facilitating rotational movement of the activity toy and walker device when the device is in at least its substantially upright orientation.

In the preferred embodiment of the invention, the activity toy and walker device further includes locking means operatively associated with the first and second portions of the frame for releasably securing the frame in its substantially upright orientation. The locking means comprise one or more retaining means operatively attached to one of the first and second portions of the frame, and one or more attachment means operatively associated with the other one of the first and second portions of the frame. The one or more retaining means releasably accept at least a portion of the one or more attachment means during the deployable positioning of the first and second portions of the frame into its substantially upright orientation. Accordingly, the one or more retaining means and the one or more attachment means collectively serve to lock the first and second portions and, in turn, the frame, in its substantially upright orientation after deployment.

In this embodiment of the invention, the one or more retaining means each include a sloped biased member having a free end, and a cavity which is positioned below at least a portion of the sloped biased member. The one or more attachment means comprise one or more rod-like members which eventually overcome at least a portion of the sloped biased member proximate the free ends of same during the deployable positioning of the frame toward and into its substantially upright orientation. The rod-like members are operatively positioned within at least a portion of the cavity of the retaining means after a portion of the one or more rod-like members have overcome the sloped biased member.

In the preferred embodiment of the invention, the deployment means comprise securement means operatively associated with the first and second portions of the frame for releasably securing the frame in its substantially collapsed orientation. The securement means comprise at least one biased lever operatively attached to one of the first and second portions of the frame and at least one notched region operatively associated with the other one of the first and second portions of the frame. At least a portion of the at least one biased lever is operatively positioned in a corresponding one of the at least one notched region when the frame is secured in its substantially collapsed orientation.

In another preferred embodiment of the invention, the deployment means further include guide means for facilitating guided alignment and manipulation of the first and second portions of the frame during deployment of same between the substantially collapsed and substantially upright orientations.

In another preferred embodiment of the invention, the activity toy and walking device further includes activity means operatively attached to at least one of the first and second portions of the frame for further prompting and promoting the interactive play, motor skill development and intellectual development of the child. The activity means may further include release means operatively associated with the activity means and a respective one of the first and second portions of the frame. These release means serve to enable removal of the activity means from the frame, to, in turn, enable independent use of the activity means by a child, if desired.

In this preferred embodiment, the release means comprises a latch operatively associated with the corresponding one of the first and second portions of the frame and the activity means. The latch comprises a projecting member operatively attached to one of the activity means and the corresponding one of the first and second portions of the frame, and a receiving aperture operatively formed in at least the other of the activity means and the first and second portions of the frame.

In another preferred embodiment of the invention, the first and second portions of the frame include recessed receiving means for operatively receiving and maintaining at least a portion of the activity means therewithin. The activity means itself, may further include audible means for providing audible messages during play with same.

Handle means operatively attached to a portion of one of the first and second portions of the frame means are also provided. These handle means serve to provide a grasping region for a child to hold onto when using the activity toy and walker device in either of its substantially upright or collapsed orientations.

BRIEF DESCRIPTION OF THE DRAWINGS

FIG. 1 of the drawings is a perspective view of the present activity toy and walker device;

FIG. 2 of the drawings is a bottom plan view of the activity toy and walker device showing, in particular, the frame in a substantially collapsed orientation;

FIG. 3 of the drawings is an elevated side view of the activity toy and walker device, showing, in particular, the top end region of the second portion of the frame being positioned proximate to the bottom end region of the first portion of the frame when the frame is in a substantially collapsed orientation;

FIG. 4 of the drawings is an enlarged fragmentary cross-sectional view of the deployment means of the activity toy and walker device, taken along lines 4—4 of FIG. 2;

FIG. 5 of the drawings is an enlarged fragmentary cross-sectional view of the release means of the activity means of the present activity toy and walker device;

FIG. 6 of the drawings is an enlarged fragmentary view of the retaining means of the locking means of the present activity toy and walker device showing, in particular, the sloped biased member and the cavity;

FIG. 7 of the drawings is an elevated perspective view of the activity toy and walker device in a substantially upright orientation;

FIG. 8 of the drawings is an elevated partially exploded perspective view of the activity toy and walker device in a substantially upright orientation, showing, in particular, the removed orientation of the activity means separate and apart from the frame;

FIG. 9 of the drawings is an elevated side view of the activity toy and walker device showing, in particular, the positioning of the top end regions of the first and second portions of the frame proximate to each other when the frame is in a substantially upright orientation; and FIG. 10 of the drawings is a bottom plan view of the activity toy and walker device.

DETAILED DESCRIPTION OF THE DRAWINGS

While this invention is susceptible of embodiment in many different forms, there is shown in the drawings and will herein be described in detail, one specific embodiment with the understanding that the present disclosure is to be considered as an exemplification of the principles of the invention and is not intended to limit the invention to the embodiment illustrated.

Activity toy and walker device 20 is shown in FIGS. 1–3 as comprising frame 21, deployment means 22 (FIGS. 2 and 4), wheel means 24, locking means **26*a*, 26*b* (FIG. 2), activity means 28 (FIG. 1) and handle means 30. Frame 21 is shown in FIG. 3 and FIG. 9 as comprising first portion 31 and second portion 32. First portion 31 includes top end region 33, bottom end region 34 and recessed region 35 (FIG. 8). Second portion 32 includes top end region 37 and bottom end region 38. Wheel means 24, which include wheels 70–73 (FIG. 2), are each operatively attached to a portion of bottom end regions 34, 38 of first and second portions 31, 32, respectively, of frame 21**.

Deployment means 22, which enables deployable positioning of frame 21 from a substantially collapsed orientation (FIGS. 1–3) toward and into a substantially upright orientation (FIGS. 7–10), are shown in FIG. 2 as comprising biased levers 39, 40, and notched regions, such as notched region 41 (FIG. 4). Each of the biased levers are operatively attached to first portion 31 of frame 21 while the corresponding notched regions are operatively formed in second portion 32 (FIG. 4) of the frame. When frame 21 is in its substantially collapsed orientation, each of the biased levers will be biased toward and into a corresponding notched region (FIG. 4) within the second portion, to, in turn, releasably secure the first and second portions of the frame into the collapsed orientation. Accordingly, when such releasable securement has occurred, top end region 37 of second portion 32 will be positioned proximate to bottom end region 34 of first portion 31 of frame 21 (FIG. 3).

Deployment of frame 21 and, in turn, deployment of first and second portions 31, 32, respectively, from the frame's substantially collapsed orientation toward and into its substantially upright orientation (FIGS. 7–10) is accomplished by manually pulling biased levers 39, 40 (FIG. 2) toward each other, to, in turn, slidably withdraw the ends of the biased levers from engagement with the corresponding notched regions within second portion 32 of frame 21. Accordingly, such disengagement of the biased levers will result in the release of the first and second portions 31, 32, respectively, of frame 21 relative to one another so as to enable operative deployment of the first and second portions toward and into a substantially upright orientation. In addition, guide means 75 (FIG. 10), which comprises a channel region on the back side 76 of first portion 31 of the frame cooperate with a portion of top end region 37 of second portion 32 so as to facilitate guided alignment and manipulation of same during deployment between the substantially collapsed and substantially upright orientations.

Locking means **26*a*, 26*b* are shown in FIGS. 2 and 10 as including retaining means 48 and attachment means 49. Retaining means 48 each include a sloped biased member 50, having a free end 52 (FIG. 6), and a cavity 51 (FIG. 6) positioned below at least a portion of the biased member. Attachment means 49 comprises a rod-like member. Although the rod-like member is shown as a single rod, which also functions as an axle for wheels 72 and 73**, it is also contemplated that the rod-like member be independent of the wheels, and/or constructed from more than one member.

In operation, locking means 26*a*, 26*b* serve to releasably secure first and second portions 31, 32 respectively, and, in turn, frame 21, in a substantially upright orientation, (as shown in FIGS. 7–10), after complete deployment of the frame from its substantially collapsed orientation. Indeed, after biased levers 39, 40 have been operatively disengaged from their corresponding notched regions, such as notched region 41 (FIG. 4), top end region 37 of second portion 32 of frame 21 can be deployed toward operative positioning proximate top end region 33 of first portion 31 of frame 21, as shown in FIG. 9. Once such positioning has been attained, at least a portion of rod-like member 49 will be positioned adjacent free end 52 of sloped biased member 50. Lockable engagement between the rod-like member and retaining means 48 can then be accomplished simply by applying downward force on that portion of the rod-like member adjacent the retaining means until such force overcomes the bias of the sloped member—thereby enabling at least a portion of the rod-like member to seat within at least a portion of cavity 51, to, in turn, releasably lock frame 21 in its substantially upright orientation.

Release of rod-like member 49 from retaining means 48, to, in turn, enable re-deployment of frame 21 back toward and into its substantially collapsed orientation (FIG. 3), is accomplished by manually depressing sloped biased members 50 proximate to their free ends 52, and then simply withdrawing rod-like member 49 therefrom. Once released, top end region 37 of second portion 32 of frame 21 can be manipulated back toward its operative positioning proximate bottom end 34 of first portion 31, to, in turn, re-orientate frame 21 into its substantially collapsed orientation—wherein biased levers 39, 40 will once again lockably engage with the corresponding notched regions in second portion 32.

Activity means 28 is shown in FIG. 7 and FIG. 8 as including release means 60 (FIG. 5) and audible means 61. Release means 60 is shown in detail in FIG. 5, as comprising slidable latch having a projecting member 63 and a grasping end 65 operatively associated with frame 21, and a receiving aperture 64 operatively formed in activity means 28. This latch and aperture combination releasably secures activity means 28 within recessed region 35 (FIG. 8) of first portion 31 of frame 21. Release of activity means 28 from frame 21 is accomplished by sliding grasping end 65 until projecting member 63 is slidably retracted from within receiving aperture 64. Accordingly, such release means will facilitate independent play of the activity means, separate and apart from frame 21, if desired. Audible means 61, which may comprise a speaker, is also shown in FIGS. 7 and 8. The speaker is operatively associated with activity means 28 so as to provide audible messages to a child when the child is playing directly with the activity means 28. Although not shown, it is contemplated that the activity means include one or more activity regions including such things as a play telephone, spinning toys and push buttons—all of which are intended to be played with by a child.

The foregoing description and drawings merely explain and illustrate the invention, and the invention is not limited thereto except insofar as the appended claims are so limited, as those skilled in the art who have the disclosure before them will be able to make modifications and variations therein within departing from the scope of the invention.

What is claimed is:

1. An activity toy and walker device for prompting and promoting interactive play, motor skill development and intellectual development of a child, said activity toy and walker device comprising:

a frame having a first portion and a second portion operatively attached to each other wherein each of said first and second portions include a top end region and a bottom end region;

deployment means operatively associated with said first and second portions of said frame for enabling deployable positioning of said frame from a substantially collapsed orientation toward and into a substantially upright orientation, each of said top end regions of said first and second portions of said frame being positioned proximate to each other when said frame is in said substantially upright orientation, locking means operatively associated with said first and second portions of said frame for releasably securing said top end regions proximate to each other when said frame is in said substantially upright orientation, said locking means enabling release of said top end regions from their proximate position relative to each other so as to allow pivotal displacement of said top end regions toward said bottom end region of the other frame portion when said frame is manipulated into said substantially collapsed orientation; and wheel means operatively attached adjacent to said bottom end regions of said first and second portions of said frame for facilitating movement of said activity toy and walker device when said device is in said substantially upright orientation.

2. The invention according to claim 1 wherein said locking means comprises:

one or more retaining means operatively attached to one of said first and second portions of said frame, and one or more attachment means operatively associated with the other one of said first and second portions of said frame, said one or more retaining means releasably accepting at least a portion of said one or more attachment means during said deployable positioning of said first and second portions of said frame into said substantially upright orientation wherein said one or more retaining means and said one or more attachment means collectively serve to lock said first and second portions and, in turn, said frame, in said substantially upright orientation after said deployment.

3. The invention according to claim 2 wherein:

said one or more retaining means each include a sloped biased member having a free end, and a cavity positioned below at least a portion of said sloped biased member, said one or more attachment means comprise one or more rod-like members;

said one or more rod-like members overcoming at least a portion of said sloped biased member proximate said free ends of same during said deployable positioning of said frame toward and into said substantially upright orientation, said one or more rod-like members being operatively positioned within at least a portion of said cavity of said retaining means after a portion of said one or more rod-like members have overcome said sloped biased member.

4. The invention according to claim 1 wherein said deployment means comprises securement means operatively associated with said first and second portions of said frame for releaseably securing said frame in said substantially collapsed orientation.

5. The invention according to claim 4 wherein said securement means comprises at least one biased lever operatively attached to one of said first and second portions of said frame and at least one notched region operatively associated with the other one of said first and second portions of the frame;

at least a portion of said at least one biased lever being operatively positioned in a corresponding one of said at least one notched region when said frame is secured in said substantially collapsed orientation.

6. The invention according to claim 1 wherein said deployment means further includes guide means for facilitating guided alignment and manipulation of said first and second portions of said frame during deployment of same between said substantially collapsed and said substantially upright orientations.

7. The invention according to claim 1 wherein said invention further includes activity means operatively attached to at least one of said first and second portions of said frame for further prompting and promoting said interactive play, motor skill development and intellectual development of a child.

8. The invention according to claim 7 wherein said activity means further includes release means operatively associated with said activity means and a respective one of said first and second portions of said frame for enabling removal of said activity means from said frame to, in turn, enable independent use of said activity means by a child, if desired.

9. The invention according to claim 8 wherein said release means comprises a latch operatively associated with said corresponding one of said first and second portions of said frame and said activity means, said latch comprising:

a projecting member operatively attached to one of said activity means and said corresponding one of said first and second portions of said frame, and a receiving aperture operatively formed in at least the other of said activity means and said first and second portions of said frame.

10. The invention according to claim 7 wherein at least one of said first and second portions of said frame include recessed receiving means for operatively receiving and maintaining at least a portion of said activity means therewithin.

11. The invention according to claim 7 wherein said activity means further includes audible means for providing audible messages during play with said activity means.

12. The invention according to claim 1 wherein the invention further includes handle means operatively attached to a portion of one of said first and second portions of said frame means so as to provide a grasping region for a child to hold onto when using said activity toy and walker device in either one of said substantially upright or collapsed orientations.

* * * * *